United States Patent [19]

Waite

[11] 4,431,363

[45] Feb. 14, 1984

[54] ARTICULATED MATERIAL HANDLING MACHINE

[75] Inventor: Jerry A. Waite, Racine, Wis.

[73] Assignee: J.I. Case Company, Racine, Wis.

[21] Appl. No.: 357,537

[22] Filed: Mar. 12, 1982

[51] Int. Cl.[3] ..... B66C 23/74

[52] U.S. Cl. ..... 414/687; 414/718; 414/719; 414/690; 414/694; 180/139; 212/189; 212/232

[58] Field of Search ..... 414/685, 687, 690, 694, 414/718, 719; 212/189, 223, 232; 180/139

[56] References Cited

U.S. PATENT DOCUMENTS

| | | | |
|---|---|---|---|
| 3,422,919 | 1/1969 | Molby et al. | 180/139 |
| 3,807,586 | 4/1974 | Holopainen | 414/694 |
| 4,064,959 | 12/1977 | Stedman et al. | 180/139 |
| 4,135,597 | 1/1979 | Barth | 180/139 |

FOREIGN PATENT DOCUMENTS

| | | | |
|---|---|---|---|
| 820094 | 8/1969 | Canada | 180/139 |
| 2415107 | 6/1975 | Fed. Rep. of Germany | 180/139 |

*Primary Examiner*—Robert J. Spar
*Assistant Examiner*—Terrance L. Siemens
*Attorney, Agent, or Firm*—Cullen, Sloman, Cantor, Grauer, Scott & Rutherford

[57] ABSTRACT

A double articulated material handling machine that is particularly adapted for use with a rotatable working tool having a cantilevered boom arm. The machine includes a front module, a central module, and a rear module with the front and rear modules being connected to the central module for pivotal motion about vertical axes. Steering of the machine is effected by double acting hydraulic rams which are mounted in symmetrical relation to the longitudinal axis of the machine. A pair of retractable and extensible stabilizers extend laterally from the central module. If the fluid steering rams on one side of the machine are retracted and the rams on the other side of the machine are extended, the front and rear modules are caused to turn through an angle relative to each other for steering or for placing the machine in a working position. The rear module may also be offset relative to the front module so that the rear traction wheels do not track or follow the front wheels which is desirable to prevent the rear wheels from following in the grooves made by the front wheels where traction is a problem. The present construction provides for improved stability to the central module against tipping forces caused by cantilevered loads on the end of the boom as the boom swings through a work radius. In a working position, the machine is articulated such that its longitudinal axis is generally parallel to the work radius of the boom arm which causes the front and rear modules to be positioned as counterweights against the load on the boom arm. The stabilizers are also extended and locked in place on the ground to provide further machine stability.

3 Claims, 4 Drawing Figures

ARTICULATED MATERIAL HANDLING MACHINE

BACKGROUND OF THE INVENTION

The present invention relates to a double articulated material handling machine that is particularly useful in transporting and providing stability to a rotatable working tool having a cantilevered boom arm.

It is known to mount a rotatable working tool such as a crane assembly having a cantilevered boom arm on a rigid frame machine. One of the problems with this type of machine is that special steering must be used thereby increasing the cost of manufacture. Another problem is stability because the load being worked upon is cantilevered from the main machine frame. Thus, there has been a need for a machine construction that is particularly adapted for use with a working tool having a cantilevered boom arm.

Articulated machines having a vertical pivot in the machine frame located approximately midway between the two drive axles are also known. These machines have primarily been used for front end loading shovels having the engine mounted at the rear. An advantage to this construction is that a shorter turning radius is possible by turning the front and rear axles relative to each other about the vertical pivot. However, this general type of machine has not heretofore been practical for use with rotatable working tools having cantilevered boom arms because of the need for substantial lateral stability when a load is applied to the cantilevered boom arm.

Thus, the disadvantages of prior material handling machine constructions have resulted in the double articulated material handling machine of the present invention which provides improved steering and stabilization for a rotatable working tool having a cantilevered boom arm.

SUMMARY OF THE INVENTION

The articulated material handling machine of the present invention includes a front module, a central module, and a rear module with the front and rear modules being supported by ground engaging wheels. The central module is generally rectangular in plan view and has upper and lower generally triangular shaped pivot plates. The front module includes upper and lower triangular flanges which are pivotally connected to the central module pivot plates by a pin for pivotal motion about a vertical axis. Similarly, the rear module has upper and lower triangular flanges which are pivotally connected to the central module pivot plates for pivotal motion about a vertical axis. Thus, the front module can pivot about its vertical axis relative to the central module and the rear module can pivot about its vertical axis relative to the central module.

The rear module includes an engine and associated transmission for driving the axle which supports the rear ground engaging wheels in a conventional manner. The axle is pivotally mounted to the rear module in a known fashion to permit oscillating movement about a horizontal axis that is transverse to the longitudinal axis of the machine for maneuvering over rough terrain. The front axle is rigidly connected to the front module and is not driven. The front module may also include an engine for driving the front ground engaging wheels or, alternatively, conventional drive connections may be provided between the rear module and front module for driving both the front and rear ground engaging wheels simultaneously.

Steering of the machine is effected by four double acting hydraulic rams which are mounted in symmetrical relation to the longitudinal axis of the articulated machine. The steering rams are pivotally connected at one end to the corners of the central module and at their opposite ends to either the front module or the rear module. The flow of hydraulic fluid to the steering rams is controlled in a known manner by means of a steering wheel and valves which permit flow of hydraulic fluid to the rams until the front and rear modules have reached a desired angularity relative to the central module.

An enclosed operator's compartment is situated on the front module and it includes front, side and rear windows so that the operator can easily see both forwardly and rearwardly for operating the machine. Suitable conventional controls such as a steering handle, valve control handles, brake pedal, accelerator pedal and the like are provided to allow the operator complete control over the machine.

A rotatable working tool having a cantilevered boom arm is mounted to the central module. The rotatable working tool includes either a crane assembly consisting of a boom and a cantilevered telescopic boom arm or a backhoe assembly consisting of a boom, dipper stick, and bucket.

A pair of retractable and extensible stabilizers extend laterally from the central module. The stabilizers are pivotally attached to the central module and they include hydraulic actuators for adjusting and locking the stabilizers in place. Vertically adjustable stabilizers may also be mounted to the front and rear modules at the opposed ends of the machine. Further, a scraper blade may be mounted to the front module to perform dual functions of scraping when desired or stabilizing the machine when the blade is lowered and locked in place.

If the fluid steering rams on one side of the machine are retracted and the rams on the other side of the machine are extended, the front and rear axles are caused to turn through an angle relative to each other. This permits a shorter turning radius when the machine is cornering. The steering system for the machine may be set to allow full articulation at the front and rear modules for short radius turning or locking the rear module and articulating the front module for highway steerage.

The present construction also permits the rear module to be offset relative to the front module so that the rear traction wheels do not track or follow the front wheels. This is desirable to prevent the rear wheels from following in the groove made by the front wheels where traction is a problem. In order to provide for offset tracking, one fluid ram and a diagonally opposite fluid ram on the generally rectangular central module are retracted while the other diagonally opposed steering rams are extended. This locks the central module in an extreme position against both the front and rear modules.

The present construction provides for improved stability to the central module against tipping forces caused by cantilevered loads on the end of the boom as the boom swings through a work radius. The machine is articulated such that its longitudinal axis is generally parallel to the work radius of the boom arm about its vertical boom axis which causes the front and rear modules to be positioned as counterweights against the load on the boom arm. The stabilizers mounted to the central module are also extended and locked in place on the ground to provide further machine stability. In this position, the center of gravity for the machine moves toward a line joining the two inner wheels and is on one side of the vertical axis for the boom while the force acting on the cantilevered boom arm is on an opposite side of the vertical axis. Thus, the central module is stabilized both by the stabilizers and the counterweight from the front and rear modules.

The articulated machine of the present invention is relatively inexpensive to produce and permits considerable flexibility in its use since its components may be standardized for interchangeability. The construction of the central module permits easy assembly and disassembly to the front and rear modules. The rear module is also constructed as a standard component for use with various rotatable working tools and includes as an additional feature a top which is adaptable for use as a support for parts of loads during machine transport.

Other advantages and meritorious features of the articulated material handling machine of the present invention will be more fully understood from the following description of the preferred embodiment, the appended claims, and the drawings, a brief description of which follows.

DETAILED DESCRIPTION OF THE INVENTION

Figure 1:
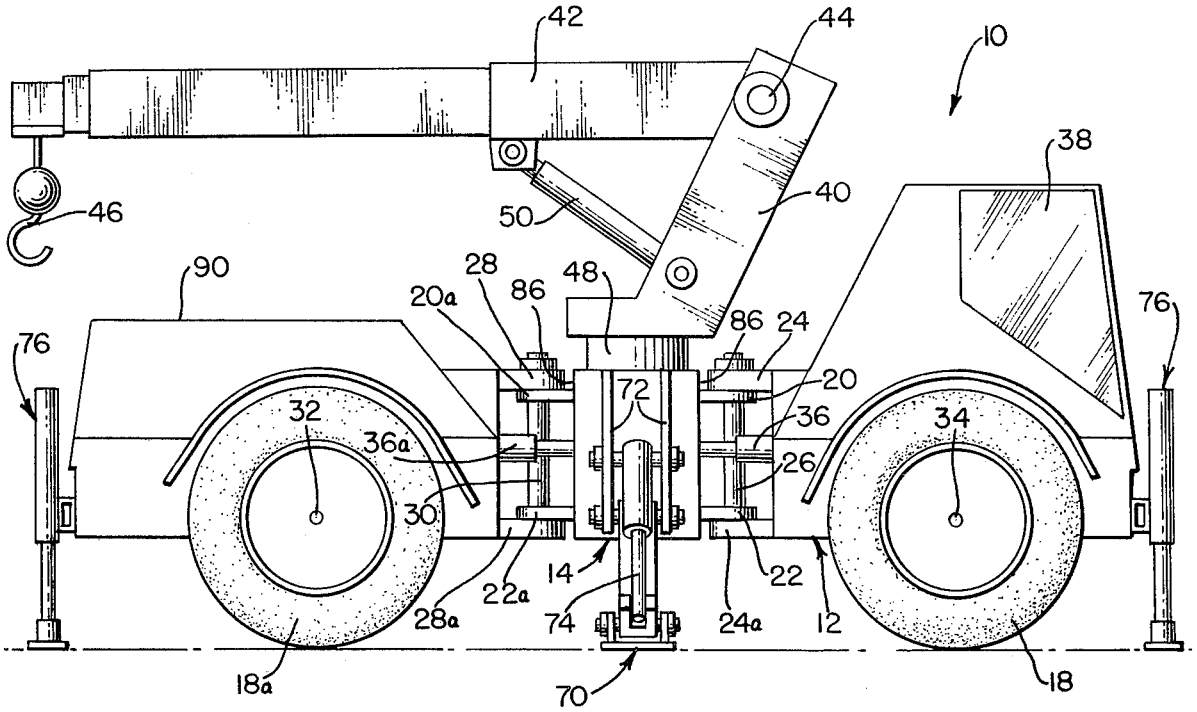
FIG. 1 is a side elevational view of the articulated material handling machine of the present invention including a crane assembly.

A preferred embodiment of an articulated material handling machine made in accordance with the teachings of the present invention is illustrated in FIGS. 1–4.

The articulated material handling machine 10 includes a front module 12, a central module 14, and a rear module 16 with the front and rear modules being supported by ground engaging wheels 18 and 18*a*. Central module 14 has upper generally triangular shaped pivot plates 20 and 20*a* and lower generally triangular pivot plates 22 and 22*a*. The front module 12 includes upper and lower triangular flanges 24 and 24*a* which are pivotally connected to central module pivot plates 20 and 22 by pin 26 for pivotal motion about a vertical axis. Similarly, rear module 16 has upper and lower triangular flanges 28 and 28*a* which are pivotally connected to central module pivot plates 20*a* and 22*a* by pin 30 for pivotal motion about a vertical axis. Thus, the front module 12 can pivot about the vertical axis of pin 26 relative to central module 14 and the rear module 16 can pivot about the vertical axis of pin 30 relative to central module 14.

The rear module 16 includes an engine and associated transmission (not shown) for driving the axle 32 which supports rear ground engaging wheels 18*a* in a conventional manner. Axle 32 is pivotally mounted to rear module 16 in a known fashion to permit oscillating movement of axle 32 about a horizontal axis that is parallel to the longitudinal axis of the machine for maneuvering over rough terrain. The front axle 34 which supports front ground engaging wheels 18 is rigidly connected to front module 12 and is not driven. Front module 12 may also include an engine for driving front ground engaging wheels 18 or, alternatively, conventional drive connections may be provided between rear module 16 and front module 12 for driving both front and rear ground engaging wheels 18 and 18*a*.

Steering of the machine is effected by four double acting hydraulic rams 36 and 36*a* which are mounted in symmetrical relation to the longitudinal axis of articulated machine 10. Rams 36 are pivotally connected at one end to the corners of central module 14 and at their opposite end to front module 12. Rams 36*a* are similarly mounted at one end to the corners of central module 14 and at their opposite end to rear module 16. The flow of hydraulic fluid to rams 36 and 36*a* is controlled in a known manner by means of a steering wheel and valves (not shown) which permit flow of hydraulic fluid to the rams until the front and rear modules 12 and 16 have reached a desired angularity relative to central module 14. This is in accordance with known principles of hydraulic steering and does not form part of the present invention.

An enclosed operator's compartment is situated on the front module 12 and it includes front, side and rear windows 38 so that the operator can easily see both forwardly and rearwardly for operating the machine. Suitable conventional controls (not shown) such as a steering handle, valve control handles, brake pedal, accelerator pedal and the like are provided to allow the operator complete control over the machine.

Figure 4:
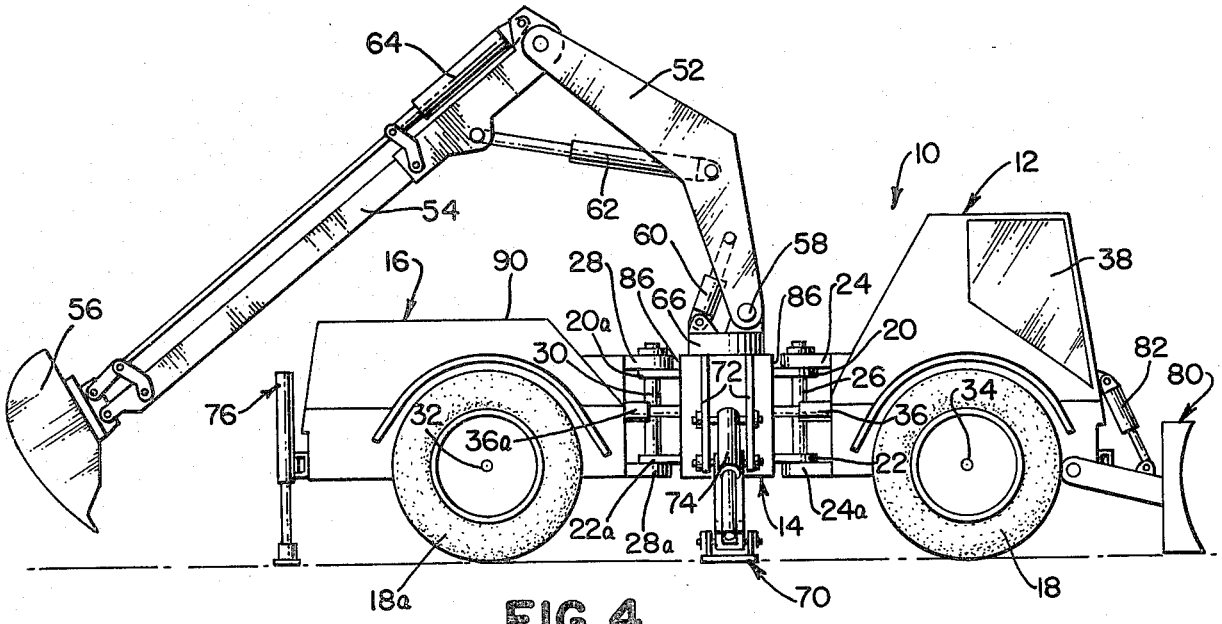
FIG. 4 is a side elevational view of the articulated material handling machine including a backhoe assembly.

As illustrated in FIGS. 1 and 4, a rotatable working tool having a cantilevered boom arm is mounted to the central module 14. The rotatable working tool shown in FIG. 1 includes a crane assembly consisting of a boom 40, a cantilevered telescopic boom arm 42 pivotally attached to boom 40 by pin 44, and an extensible and retractable attaching hook 46. Boom 40 is mounted to a rotatable pad member 48 on central module 14 and boom arm 42 is raised and lowered relative to boom 40 by hydraulic actuator 50. Similarly, FIG. 4 illustrates a hydraulic backhoe assembly mounted to central module 14 consisting of a boom 52, a dipper stick 54, and a bucket 56. Boom 52 is rotated about its pivot 58 by means of hydraulic actuator 60. The dipper stick is rotated about the end of boom 52 by hydraulic actuator 62 while bucket 56 is rotated about its axis on the end of dipper stick 54 by means of actuator 64. Boom 52 is also mounted to a rotatable pad member 66 on central module 14.

A pair of retractable and extensible stabilizers 70 extend laterally from central module 14. Stabilizers 70 are pivotally attached to brackets 72 on module 14 and they include hydraulic actuators 74 for adjusting and locking the stabilizers in place. Vertically adjustable stabilizers 76 are mounted to the front and rear modules 12 and 16 at the opposed ends of articulated machine 10 as shown in FIG. 1 or only to one end of the machine as shown in FIG. 4. Further, as shown in FIG. 4, a scraper blade 80 which is raised and lowered by actuator 82 may be mounted to the front module 12 to perform dual functions of scraping when desired or stabilizing when the blade is lowered and locked in place.

Figure 3:
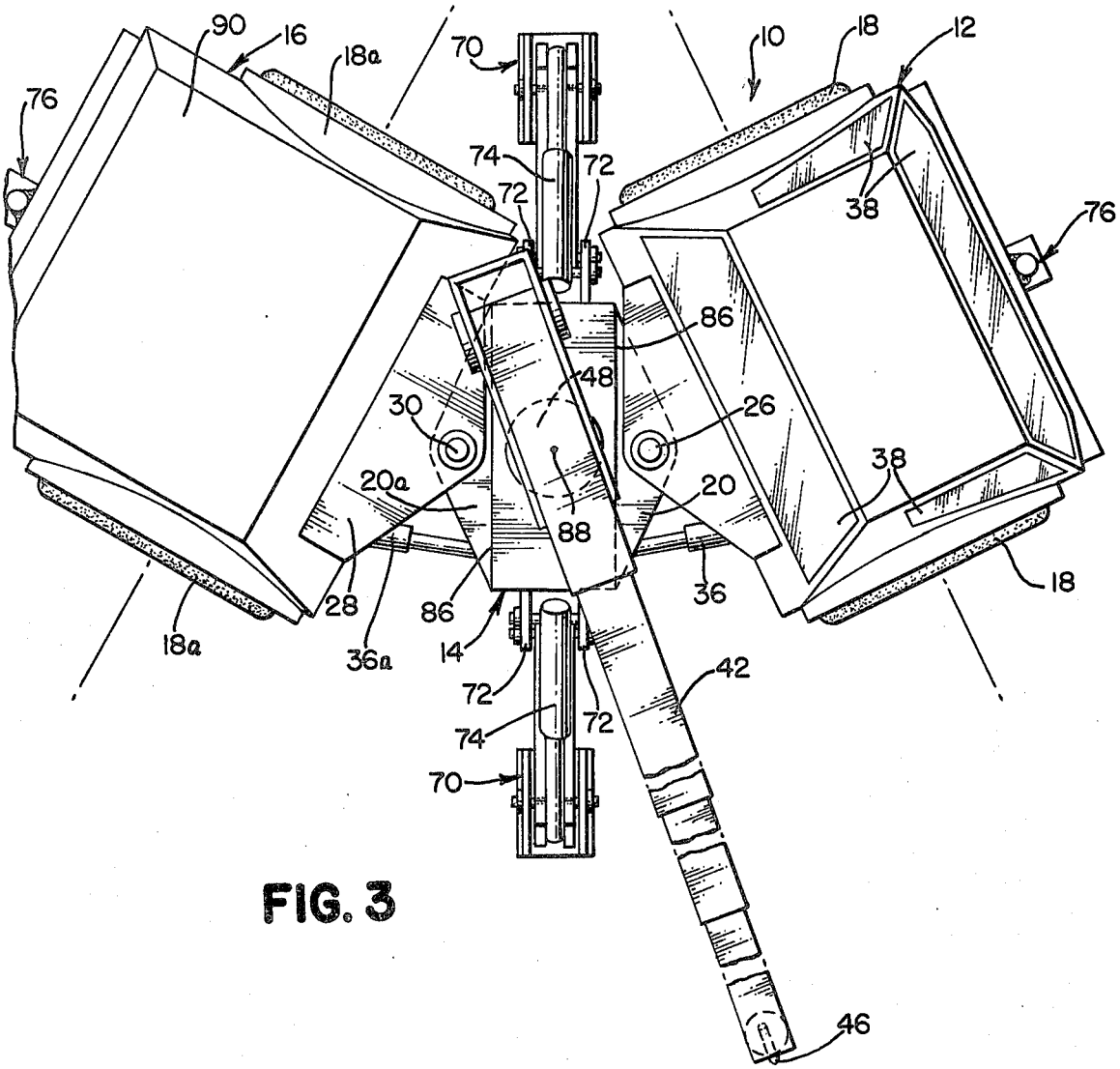
FIG. 3 is a top plan view of the articulated material handling machine in a working position.

In the position of articulated machine 10 shown in FIGS. 1 and 4, axles 32 and 34 are parallel and steering rams 36 and 36*a* are equally extended for straight-ahead steering. If the fluid rams 36 and 36*a* on one side of the machine are retracted and the rams on the other side of the machine are extended, the front and rear axles 32 and 34 are caused to turn through an angle relative to each other as shown in FIG. 3. This permits a shorter turning radius when the machine is cornering. The steering system for the machine may be set to allow full articulation at the front and rear modules 12 and 16 for short radius turning or locking the rear module and articulating the front module for highway steerage.

Figure 2:
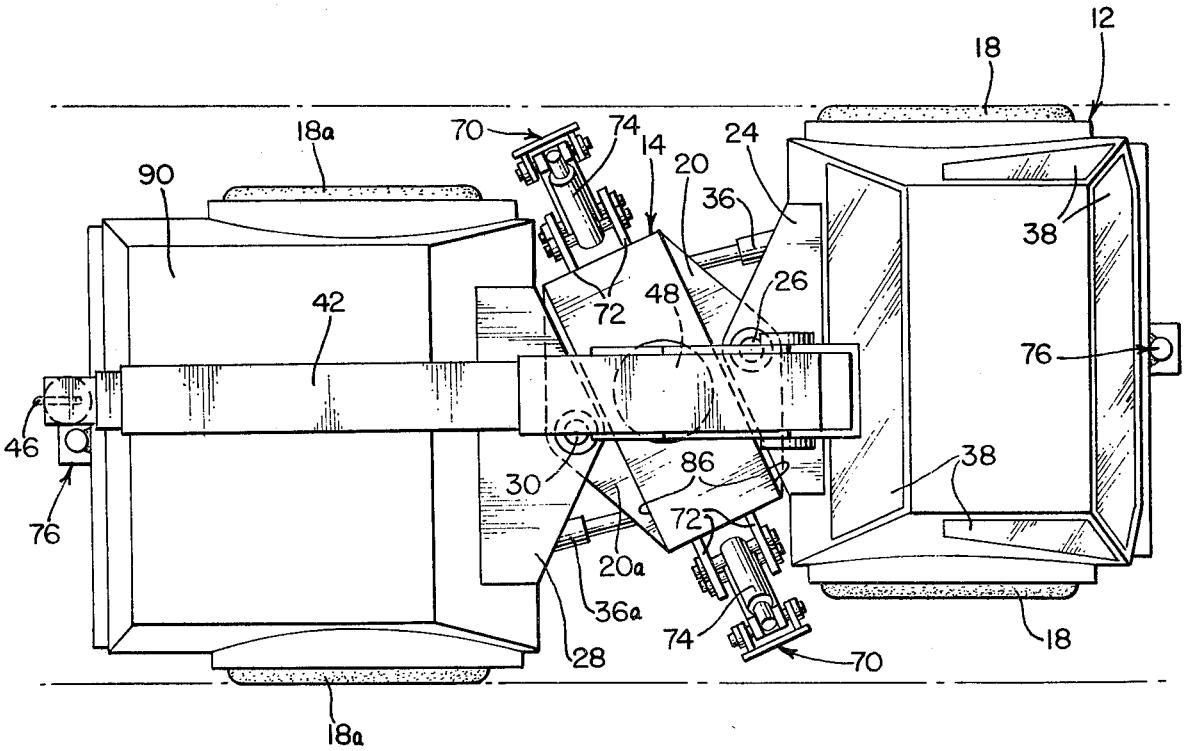
FIG. 2 is a top plan view of the articulated material handling machine illustrating its offset tracking capability.

As illustrated in FIG. 2, the present construction permits the rear module 16 to be offset relative to the front module 12 so that the rear traction wheels 18*a* do not track or follow the front wheels 18. This is desirable to prevent the rear wheels from following in the groove made by the front wheels where traction is a problem. In order to provide for offset tracking as shown in FIG. 2, one fluid ram 36 and a diagonally opposite fluid ram 36*a* on generally rectangular central module 14 are retracted while the other diagonally opposed fluid rams 36 and 36*a* are extended. This locks central module 14 in an extreme position against both front and rear modules 12 and 16. That is, the sides 86 of central module 14 substantially abut against the edges of flanges 24 and 28 on front and rear modules 12 and 16.

The present construction provides for improved stability to central module 14 against tipping forces caused by cantilevered loads on the end of boom 42 as boom 42 swings through a work radius. Referring to FIG. 3, the improved articulated machine 10 is illustrated in a working position with the fluid rams 36 and 36*a* on one side of the machine being retracted and the fluid rams 36 and 36*a* on the opposite side of the machine being extended. That is, the machine is articulated such that its longitudinal axis is generally parallel to the work radius of boom arm 42 about vertical boom axis 88 which causes front and rear modules 12 and 16 to be positioned as counterweights against the load on boom arm 42. Stabilizers 70 and 76 are also extended and locked in place on the ground to provide further machine stability from front to back and from side to side. In the position shown in FIG. 3, the center of gravity for the machine moves toward a line joining the two inner wheels on one side of the vertical axis 88 for boom 40 while the force acting on the cantilevered boom arm 42 is on an opposite side of vertical axis 88. Thus, central module 14 is stabilized both by stabilizers 70 and the counterweight from front and rear modules 12 and 16.

The articulated machine 10 of the present invention is relatively inexpensive to produce and permits considerable flexibility in its use since its components may be standardized for interchangeability. The central module 14 is generally rectangular in plan view and includes stabilizers 70 mounted on its opposed ends and steering rams 36 and 36*a* attached adjacent its corners. This construction permits easy assembly and disassembly to front and rear modules 12 and 16. Rear module 16 is also constructed as a standard component for use with various rotatable working tools as shown in FIGS. 1 and 4 and it includes the additional feature of a top 90 which is adaptable for use as a support for parts or loads during machine transport. While the operator's station has been illustrated on the front module 12, the operator's station could be moved to the central module 14 for larger capacity machines to permit greater visibility over the working tool.

It will be apparent to those skilled in the art that the foregoing disclosure is exemplary in nature rather than limiting, the invention being limited only by the appended claims.

I claim:

1. An articulated material handling machine including a front module, a central module, and a rear module with the front and rear modules being supported by ground engaging wheels mounted on front and rear axles, said front module pivotally connected to said central module for pivotal movement about a first vertical axis and said rear module pivotally connected to said central module for pivotal movement about a second vertical axis, and said front axle being rigidly attached to said front module, said central module being generally rectangular in plan view, fluid steering rams pivotally mounted at one end adjacent the corners of said central module in symmetrical relation to the longitudinal axis of said machine and on opposed sides thereof, the opposite ends of a pair of said steering rams being connected to said front module and the opposite ends of another pair of said steering rams being connected to said rear module, an operator's station mounted on said front module and a rotatable working tool having a cantilevered boom arm mounted to said central module and said boom arm operating along a work radius laterally spaced from one side of said machine, a pair of retractable and extensible stabilizers pivotally attached to said central module, said machine being adapted for offset steering by retracting a pair of diagonally opposite steering rams on said central module and extending another pair of diagonally opposite steering rams on said central module for locking said central module in an extreme position against said front and rear modules thereby offsetting said rear module relative to said front module so that the rear ground engaging wheels do not track the front ground engaging wheels, and said machine being placed in a working position by extending the fluid steering rams on one side of said machine while retracting the steering rams on the opposite side of the machine whereby said machine is articulated such that its longitudinal axis generally parallel to the work radius of said boom arm and said front and rear modules being positioned as counterweights against any load applied to the end of said boom arm, and said stabilizers being extended and locked in place to provide further stability to said central module.

2. The articulated material handling machine as defined in claim 1 including vertically adjustable stabilizers mounted to the front and rear modules at opposite ends of said machine.

3. The articulated material handling machine as defined in claim 1 including a vertically adjustable stabilizer mounted to the rear module and a vertically adjustable scraper blade mounted to the front module.

* * * * *